US007882636B2

(12) United States Patent
Mita et al.

(10) Patent No.: US 7,882,636 B2
(45) Date of Patent: Feb. 8, 2011

(54) INKJET HEAD, METHOD OF MANUFACTURING INKJET HEAD, AND INKJET RECORDING APPARATUS

(75) Inventors: Tsuyoshi Mita, Kanagawa (JP); Kazuo Sanada, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 0 days.

(21) Appl. No.: 12/490,145

(22) Filed: Jun. 23, 2009

(65) Prior Publication Data

US 2009/0260207 A1 Oct. 22, 2009

Related U.S. Application Data

(62) Division of application No. 10/948,173, filed on Sep. 24, 2004, now abandoned.

(30) Foreign Application Priority Data

Sep. 26, 2003 (JP) ..... 2003-336238

(51) Int. Cl.
*B21D 53/76* (2006.01)

(52) U.S. Cl. ..... 29/890.1; 29/25.35

(58) Field of Classification Search ..... 29/25.35, 29/890.1

See application file for complete search history.

(56) References Cited

U.S. PATENT DOCUMENTS 6,584,660 B1 * 7/2003 Shimogawa et al. ..... 29/25.35
2002/0130929 A1 9/2002 Murai
2002/0175975 A1 * 11/2002 Mitsuhashi et al. ..... 347/70
2002/0189099 A1 12/2002 Nishikawa
2003/0190041 A1 10/2003 Yokota et al.

FOREIGN PATENT DOCUMENTS

| | | | |
|---|---|---|---|
| EP | 0 928 033 | A2 | 7/1999 |
| EP | 0 928 034 | A2 | 7/1999 |
| JP | 58-108163 | A | 6/1983 |
| JP | 2-187352 | A | 7/1990 |
| JP | 5-229115 | A | 9/1993 |
| JP | 10-81016 | A | 3/1998 |
| JP | 2000-79686 | A | 3/2000 |
| JP | 2003-8096 | A | 1/2003 |
| JP | 2003-94655 | A | 4/2003 |
| JP | 2003-127366 | A | 5/2003 |
| JP | 2003-159799 | A | 6/2003 |

* cited by examiner

*Primary Examiner*—A. Dexter Tugbang
*Assistant Examiner*—Azm Parvez
(74) *Attorney, Agent, or Firm*—Birch, Stewart, Kolasch and Birch, LLP

(57) ABSTRACT

An inkjet head, comprising:

a pressure chamber which are arranged two-dimensionally, and deformed by pressure generating unit and discharging ink from nozzles communicated with the pressure chamber; and a piezoelectric element which is included in the pressure generating unit, said piezoelectric element including a thin film piezoelectric element formed by means of a thin film forming technique.

7 Claims, 6 Drawing Sheets

INKJET HEAD, METHOD OF MANUFACTURING INKJET HEAD, AND INKJET RECORDING APPARATUS

This application is a Divisional application of U.S. application Ser. No. 10/948,173 filed on Sep. 24, 2004 now abandoned. U.S. application Ser. No. 10/948,173 claims priority under 35 U.S.C. 119(a) to Patent Application No. 2003-336238 filed in Japan on Sep. 26, 2003. All of which are hereby expressly incorporated by reference into the present application in their entirety.

BACKGROUND OF THE INVENTION

1. Field of the Invention

The present invention relates to an inkjet head, a method of manufacturing the inkjet head, and an inkjet recording apparatus. More particularly, the present invention relates to an inkjet head, a method of manufacturing the inkjet head, and an inkjet recording apparatus in which a portion of a pressure chamber is formed by a vibration plate, and the vibration plate is deformed by displacement of a piezoelectric element provided on the vibration plate, thereby changing the volume of the pressure chamber and hence discharging an ink droplet.

2. Description of the Related Art

Inkjet printers (inkjet recording apparatuses) are known which use a so-called inkjet method, where an image is recorded by discharging and propelling ink (ink droplets) from the nozzles of an inkjet head, and causing same to adhere to recording paper, or the like. There are various ink discharge methods for recording heads (inkjet heads) based on an inkjet method. One known method is a piezoelectric method, where the volume of a pressure chamber is changed by causing a vibration plate forming a portion of the pressure chamber to deform due to deformation of a piezoelectric element (piezoelectric ceramic), ink being introduced into the pressure chamber from an ink supply passage when the volume is increased, and the ink inside the pressure chamber being discharged as a droplet from the nozzle when the volume of the pressure chamber is reduced. Another known method is a thermal inkjet method where ink is heated to generate a bubble in the ink, and ink is then discharged by means of the expansive energy created as the bubble grows.

An inkjet head using a piezoelectric element, for example, has a laminated structure comprising piezoelectric elements, a vibration plate, a flow passage plate formed with an ink supply passage and pressure chambers, a nozzle plate formed with ink discharge ports (orifice plates), and the like, mounted on a substrate. The head is manufactured by bonding these respective plates together.

Japanese Patent Application Publication No. 2003-94655 describes a method of manufacturing an inkjet head comprising a laminated plate structure of this kind. If piezoelectric elements are formed by general calcination of a thin film, then warping occurs due to the thermal stress generated during the calcination process. Therefore, in order to suppress warping due to thermal stress, in this method, pressure generating mechanisms consisting of piezoelectric elements for driving a vibration plate are formed by inserting a metal film between at least two piezoelectric layers, performing general calcination of the whole structure, and then removing the unnecessary portion in order to obtain a thin film.

This method of manufacture is as follows. In other words, firstly, a thin metal film is sandwiched between a first, 400 μm-thick, piezoelectric layer formed by layering together ten 40 μm-thick uncalcined green sheets, and a second piezoelectric layer consisting of one 40 μm-thick green sheet. A thin metal film for forming electrodes is applied to the lower side of the second piezoelectric layer, and the composition is then laminated together in a press and calcined to form a unified structure. A thermofoam type sheet is then applied to the structure, and the first piezoelectric layer, which is not required in the pressure generating mechanism, is removed by sand-blasting, using the sandwiched thin metal film as a stopper. In this way, the film thickness of the resulting structure is reduced.

Next, the thin metal film forming the stopper is peeled away, and a thin metal film for creating electrodes is formed by sputtering, or the like, on the upper side of the second piezoelectric layer. In this way, the second piezoelectric layer has thin metal films for forming electrodes on its upper and lower surfaces. This second piezoelectric layer is then divided so as to correspond with the positions of the pressure chambers. The second piezoelectric layer which has been divided according to the positions of the pressure chambers is then placed over a vibration plate incorporated with an ink flow passage plate formed with pressure chambers, and the like, the position of the second piezoelectric layer is aligned with the positions of the pressure chambers, and it is then bonded to the vibration plate. Finally, the thermofoam type sheet is peeled away by applying heat, thereby completing the head.

SUMMARY OF THE INVENTION

However, if a method employing thick films, such as a green sheet method or a printing method, is used to form piezoelectric bodies, as in the prior art described above, then there are limits on the thickness of each layer. The method disclosed in Japanese Patent Application Publication No. 2003-94655 uses green sheets which are 40 μm thick, for example, but even if other types of sheet are used, they are still limited to a thickness of approximately 20 μm.

Generally, in a unimorph structure driving in d31 mode, given constant dimensions for the pressure chamber, the displacement of the piezoelectric element will increase, the smaller the thickness of the piezoelectric layer. The reason for this is as follows. Taking the displacement of the piezoelectric element to be δ1, the applied voltage to be V, the shape of the pressure chamber to be square, the length of one edge of the pressure chamber to be L, and the thickness of the piezoelectric layer to be t, then the following equation (1) is established when the piezoelectric element is used in d31 mode.

$$\delta 1 = d31 \times V \times L/t \quad (1)$$

As equation (1) indicates, at constant values of V and L, the displacement, δ1, will become larger, the smaller the value of t. In other words, if the size L of the pressure chamber is uniform, then a greater displacement δ1 will be produced, the smaller the thickness of the piezoelectric layer, t. Stated alternatively, the smaller the thickness of the piezoelectric layer, t, the smaller the size of the pressure chamber L required to obtain the same displacement, δ1. If the size of the pressure chamber can be reduced, then the placement density of the pressure chambers and nozzles can be increased accordingly.

However, with conventional methods using thick films, even if it is attempted to reduce the size of the pressure chamber, there are still limits on the dimensions of the pressure chamber (its surface area in the X-Y plane), as the pressure chamber must have sufficient ink emission volume to perform satisfactory discharge of ink droplets. This in turn restricts the nozzle placement density, and hence a drawback arises in that the nozzle density cannot be increased beyond a certain limit.

There is a further drawback in that, due to problems relating to crystalline properties and internal pores, voltage tolerance is low and the ratio of voltage V to thickness t (V/mm) cannot be raised to a high value. Therefore, even if the size L of the pressure chamber is reduced considerably, it is still not possible to achieve a large displacement, δ1.

The present invention was devised with the foregoing in view, an object thereof being to provide an inkjet head, a method of manufacturing an inkjet head, and an inkjet recording apparatus, whereby the size of pressure chambers can be reduced, and the density of nozzle placement can be increased.

In order to achieve the aforementioned object, the present invention provides an inkjet head, comprising:

a pressure chamber which are arranged two-dimensionally, and deformed by pressure generating unit and discharging ink from nozzles communicated with the pressure chamber; and a piezoelectric element which is included in the pressure generating unit, said piezoelectric element including a thin film piezoelectric element formed by means of a thin film forming technique.

Therefore, by reducing the film thickness of the piezoelectric element, the displacement of the element can be increased. Consequently, the size of the pressure chamber can be reduced, and nozzles can be placed at higher density by arranging pressure chambers two-dimensionally (in a matrix arrangement).

Furthermore, in the inkjet head of the present invention, a portion of said pressure chamber may be formed by a vibration plate, and said pressure generating unit may be manufactured by bonding said thin film piezoelectric element to said vibration plate. Therefore, the piezoelectric element and the vibration plate can be manufactured separately, and the vibration plate, pressure chamber and nozzle can be manufactured by means of conventional methods. This allows stable production. It is also makes it possible to reduce the occurrence of breakdowns in the piezoelectric elements, or other faults caused by warping of the vibration plate or internal stress during formation of the thin films.

Furthermore, in the inkjet head of the present invention, said pressure generating unit may be manufactured by bonding said thin film piezoelectric element formed on a substrate with said vibration plate, and then removing said substrate. By this means, since the thin film piezoelectric element is formed on a substrate, the piezoelectric element is easy to handle in the processes up to and including bonding to the vibration plate, even though the piezoelectric elements themselves are thin.

Furthermore, desirably, in the inkjet head of the present invention, the vibration plate is manufactured by processing stainless steel, or it is manufactured integrally with the pressure chambers by using silicon. Moreover, desirably, the pressure generating unit has a groove formed in the vibration plate on the side bonded with the thin film piezoelectric element. The fact that the piezoelectric element and the vibration plate are formed separately, as described above, allows greater freedom of choice in respect of material and shape of the vibration plate. By inserting grooves in the vibration plate, it is possible to reduce the rigidity of the vibration plate and increase its displacement. Therefore, the pressure chamber can be further reduced in size.

Furthermore, similarly, in order to achieve the aforementioned objects, the invention provides a method of manufacturing an inkjet head, comprising the steps of:

two-dimensionally arranging a pressure chamber, deformed by a pressure generating unit comprising a piezoelectric element and discharging ink from nozzles communicated with the pressure chamber; and forming said piezoelectric element by means of a thin film forming technique.

In this way, the size of the pressure chamber can be reduced and hence the pressure chamber can be adapted to a high-density nozzle.

Furthermore, in the method of manufacturing an inkjet head of the present invention, a portion of the pressure chamber is formed by a vibration plate, and the pressure generating unit is manufactured by bonding the thin film piezoelectric element to the vibration plate. By manufacturing the piezoelectric elements and the vibration plate separately in this way, it is possible to use conventional methods for manufacturing the members from the vibration plate through to the nozzle. Therefore stable production can be achieved. Furthermore, it is also possible to reduce the occurrence of breakdowns in the piezoelectric elements, or other faults caused by warping of the vibration plate or internal stress during formation of the thin films.

In the method of manufacturing an inkjet head of the present invention, the pressure generating units are manufactured by forming the thin film piezoelectric element onto a substrate, bonding the thin film piezoelectric elements formed on the substrate with the vibration plate, and then removing the substrate. This facilitates handling of the thin film piezoelectric element.

Moreover, in the method of manufacturing an inkjet head of the present invention, desirably, the vibration plate is manufactured by processing stainless steel, or it is manufactured integrally with the pressure chamber by using silicon. Furthermore, desirably, the pressure generating unit have a groove formed on the vibration plate on the side bonded with the thin film piezoelectric element. In this way, there is freedom of choice in respect of the material and shape of the vibration plate. By providing grooves on the vibration plate, the displacement can be increased.

Furthermore, similarly, in order to achieve the aforementioned objects, the invention comprises an inkjet recording apparatus comprising:

an inkjet head wherein a pressure chamber, deformed by a pressure generating unit comprising a piezoelectric element and discharging ink from a nozzle communicated with the pressure chamber, are arranged two-dimensionally, and said piezoelectric element is formed by means of a thin film forming technique.

In this way, a high-density inkjet recording apparatus corresponding to a matrix arrangement is achieved by using thin film piezoelectric elements.

As described above, according to the inkjet head, the method of manufacturing an inkjet head, and the inkjet recording apparatus relating to the present invention, it is possible to reduce the size of pressure chambers arranged two-dimensionally, and therefore, it is possible achieve high nozzle density.

BRIEF DESCRIPTION OF THE DRAWINGS

FIG. 5A shows state where a three-layer structure comprising electrodes and a piezoelectric element have been formed on a substrate; FIG. 5B shows a state where the three-layer structure comprising electrodes and a piezoelectric element has been divided so as to correspond with pressure chambers; FIG. 5C shows a state where a vibration plate, pressure chambers and nozzles have been formed; FIG. 5D shows a state where the three-layer piezoelectric element structures have been bonded to the vibration plate; and FIG. 5E shows a state where the substrate has been removed from the three-layer piezoelectric element structure, and a head has been completed.

DESCRIPTION OF THE PREFERRED EMBODIMENTS

Following is detailed description of an inkjet head, a method of manufacturing the inkjet head, and an inkjet recording apparatus relating to the present invention, along drawings attached.

Figure 1:
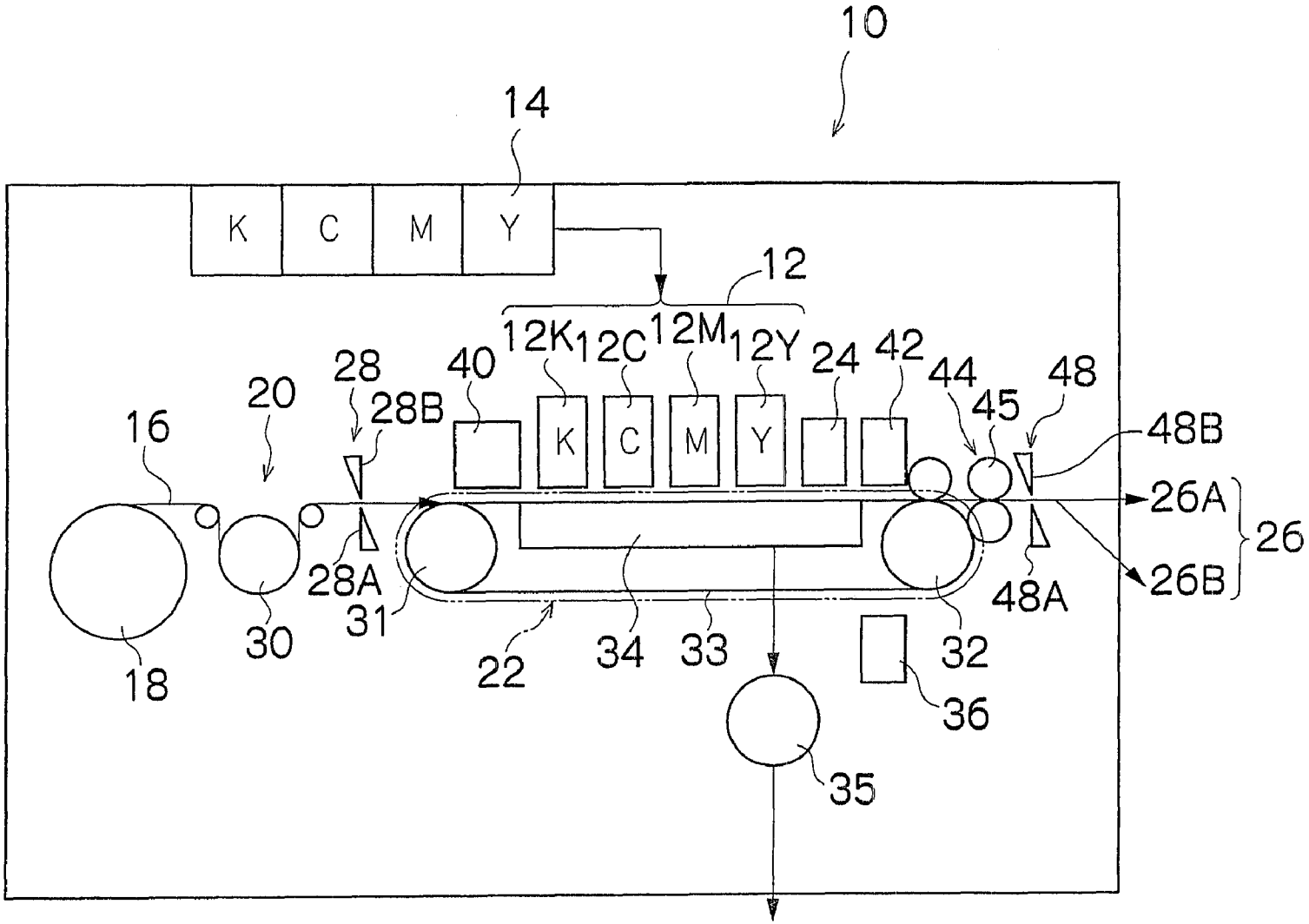
FIG. 1 is a general compositional view showing an embodiment of an inkjet recording apparatus using an inkjet head relating to the present invention.

FIG. 1 is a general schematic drawing of an inkjet recording apparatus according to an embodiment of the present invention. As shown in FIG. 1, the inkjet recording apparatus 10 comprises: a printing unit 12 having a plurality of print heads 12K, 12C, 12M, and 12Y for ink colors of black (K), cyan (C), magenta (M), and yellow (Y), respectively; an ink storing/loading unit 14 for storing inks to be supplied to the print heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In FIG. 1, a single magazine for rolled paper (continuous paper) is shown as an example of the paper supply unit 18; however, a plurality of magazines with paper differences such as paper width and quality may be jointly provided. Moreover, paper may be supplied with a cassette that contains cut paper loaded in layers and that is used jointly or in lieu of a magazine for rolled paper.

In the case of the configuration in which roll paper is used, a cutter (first cutter) 28 is provided as shown in FIG. 1, and the continuous paper is cut into a desired size by the cutter 28. The cutter 28 has a stationary blade 28A, whose length is equal to or greater than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut paper is used, the cutter 28 is not required.

In the case of a configuration in which a plurality of types of recording paper can be used, it is preferable that a information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1; and the suction chamber 34 provides suction with a fan 35 to generate a negative pressure, and the recording paper 16 is held on the belt 33 by suction.

The belt 33 is driven in the clockwise direction in FIG. 1 by the motive force of a motor (not shown in FIG. 1) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not depicted, examples thereof include a configuration in which the belt 33 is nipped with a cleaning roller such as a brush roller and a water absorbent roller, an air blow configuration in which clean air is blown onto the belt 33, or a combination of these. In the case of the configuration in which the belt 33 is nipped with the cleaning roller, it is preferable to make the line velocity of the cleaning roller different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

The printing unit 12 forms a so-called full-line head in which a line head having a length that corresponds to the maximum paper width is disposed in the main scanning direction perpendicular to the delivering direction of the recording paper 16 (hereinafter referred to as the paper conveyance direction, namely, sub scanning direction), which is substantially perpendicular to a width direction of the recording paper 16. Each of the print heads 12K, 12C, 12M, and 12Y is composed of a line head, in which a plurality of ink-droplet ejection apertures (nozzles) are arranged along a length that exceeds at least one side of the maximum-size recording paper 16 intended for use in the inkjet recording apparatus 10.

The print heads 12K, 12C, 12M, and 12Y corresponding to black(K), cyan(c), magenta(M) and yellow(Y), respectively, are arranged in this order from the upstream side along the paper conveyance direction (sub scanning direction). A color print can be formed on the recording paper 16 by ejecting the inks from the print heads 12K, 12C, 12M, and 12Y, respectively, while conveying the recording paper 16.

The print unit 12, in which the full-line heads covering the entire width of the paper are thus provided for the respective ink colors, can record an image over the entire surface of the recording paper 16 by performing the action of moving the recording paper 16 and the print unit 12 relatively to each other in the sub-scanning direction just once (i.e., with a single sub-scan). Higher-speed printing is thereby made possible and productivity can be improved in comparison with a shuttle type head configuration in which a print head reciprocates in the main scanning direction.

Although the configuration with the KCMY four standard colors is described in the present embodiment, combinations of the ink colors and the number of colors are not limited to those, and light and/or dark inks can be added as required. For example, a configuration is possible in which print heads for ejecting light-colored inks such as light cyan and light magenta are added.

As shown in FIG. 1, the ink storing/loading unit 14 has tanks for storing the inks to be supplied to the print heads 12K, 12C, 12M, and 12Y, and the tanks are connected to the print heads 12K, 12C, 12M, and 12Y through channels (not shown), respectively. The ink storing/loading unit 14 has a warning device (e.g., a display device, an alarm sound generator) for warning when the remaining amount of any ink is low, and has a mechanism for preventing loading errors among the colors.

The print determination unit 24 has an image sensor such as a line sensor for capturing an image of the ink-droplet deposition result of the print unit 12, and functions as a device to check for ejection defects such as clogs of the nozzles in the print unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern printed with the print heads 12K, 12C, 12M, and 12Y for the respective colors, and the ejection of each head is determined. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathway in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B. Although not shown in FIG. 1, a sorter for collecting prints according to print orders is provided to the paper output unit 26A for the target prints.

Next, the structure of the print heads (the inkjet heads) is described. The print heads 12K, 12C, 12M, and 12Y provided for the ink colors have the same structure, and a reference numeral 50 is hereinafter designated to any of the print heads 12K, 12C, 12M, and 12Y.

Figure 2A:
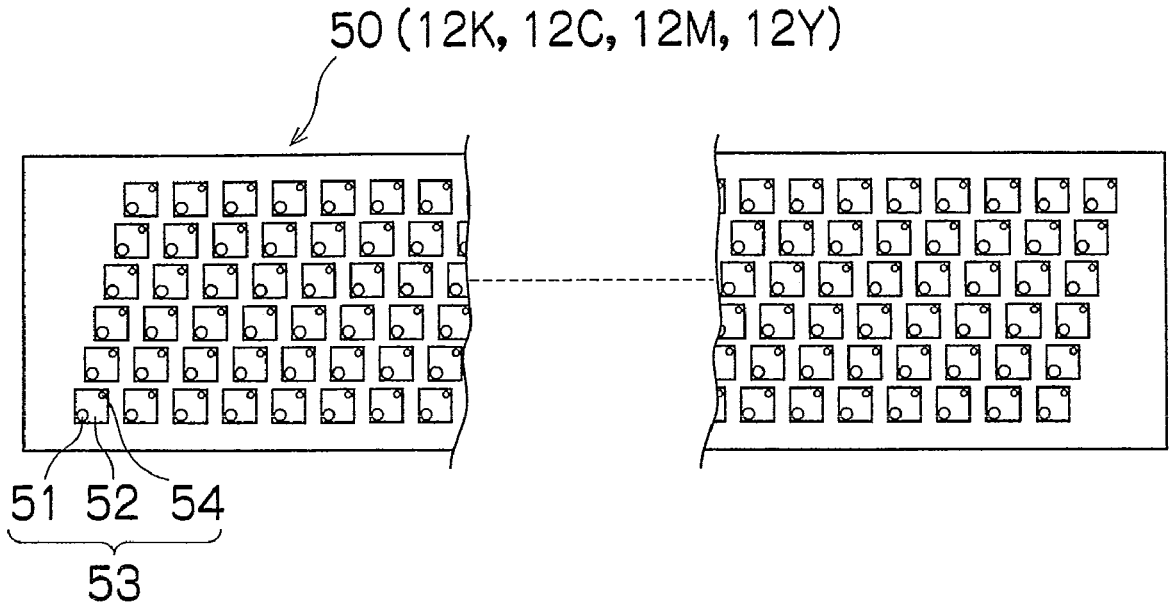
FIG. 2A is a plan diagram showing an example of the structure of a print head (inkjet head)
Figure 2B:
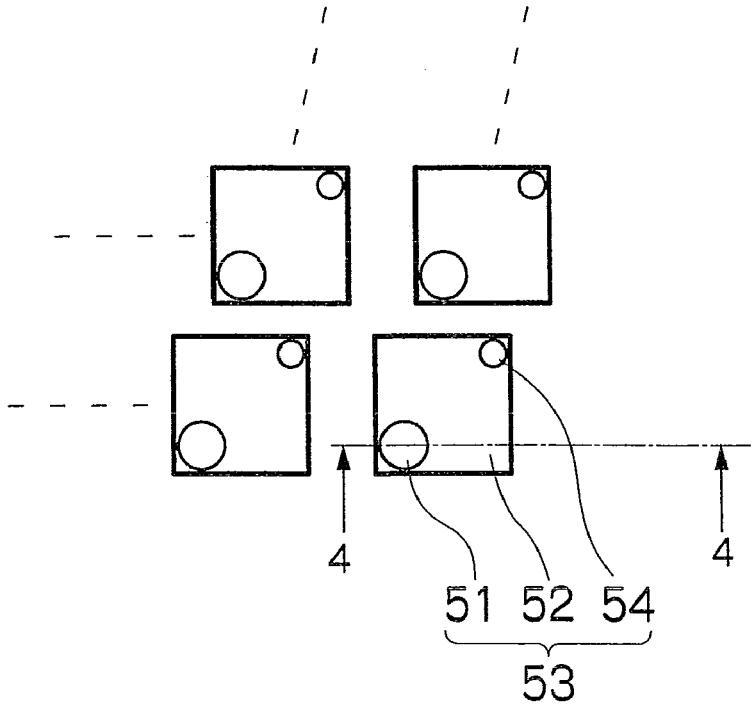
FIG. 2B is a partial enlarged view of FIG. 2A.

FIG. 2A is a perspective plan view showing an example of the configuration of the print head 50, FIG. 2B is an enlarged view of a portion thereof. The nozzle pitch in the print head 50 should be minimized in order to maximize the density of the dots printed on the surface of the recording paper. As shown in FIG. 2A, the print head 50 in the present embodiment has a structure in which a plurality of ink chamber units 53 including nozzles 51 for ejecting ink-droplets and pressure chambers 52 connecting to the nozzles 51 are disposed in the form of a staggered matrix, and the effective nozzle pitch is thereby made small.

The planar shape of the pressure chamber 52 provided for each nozzle 51 is substantially a square, and the nozzle 51 and supply port 54 are disposed in both corners on a diagonal line of the square. Each pressure chamber 52 is connected to a common channel through a supply port 54.

A piezoelectric element (piezoelectric actuator) 58 having an upper electrode (discrete electrode) 57 is joined to a vibration plate (pressure plate) 56, which forms the ceiling of the pressure chamber 52, and the element 58 is deformed by applying drive voltage to the upper electrode 57 to eject ink from the nozzle 51. When ink is ejected, new ink is delivered from the common flow channel through the supply port 54 to the pressure chamber 52.

Figure 3:
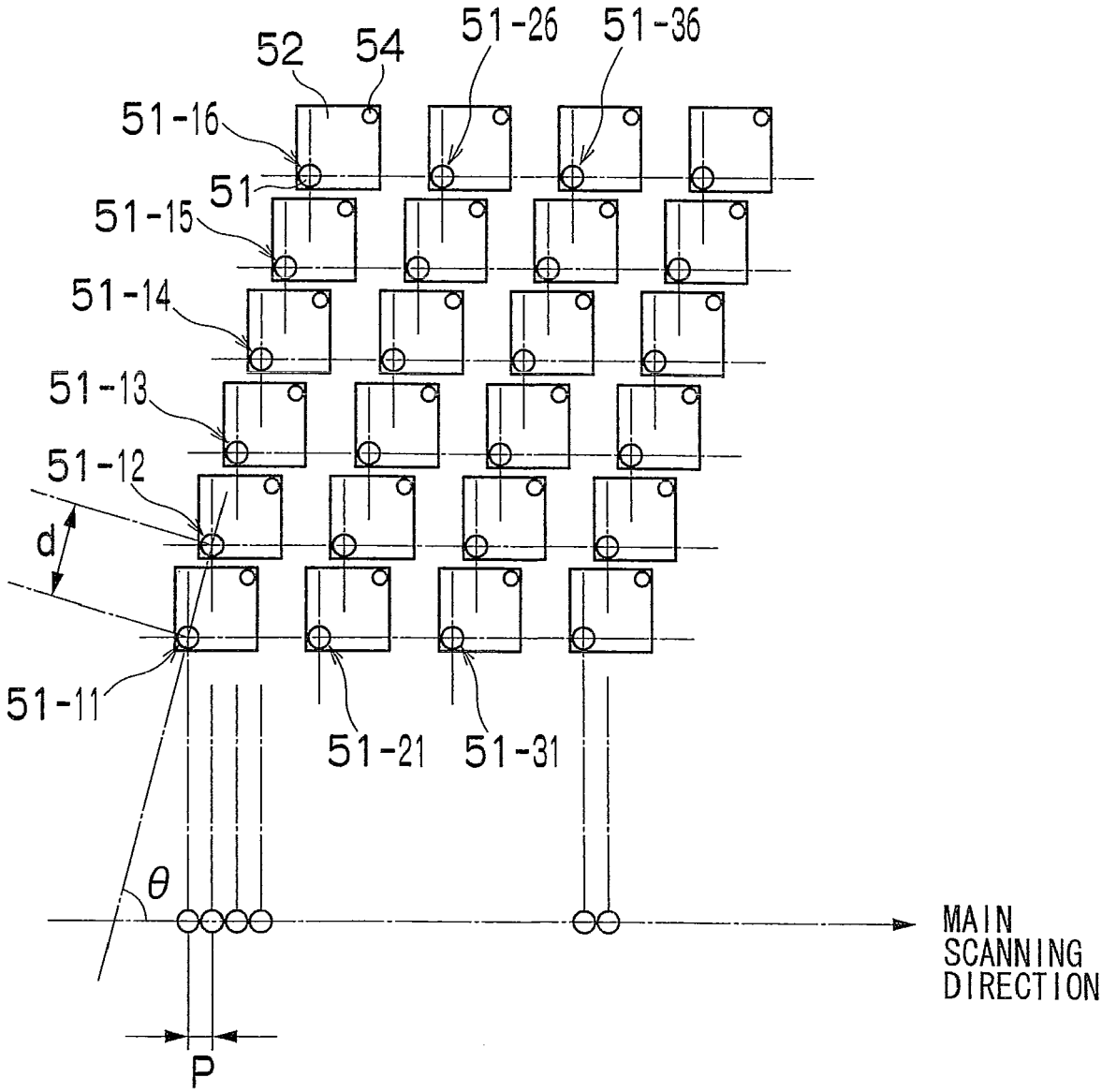
FIG. 3 is an enlarged view showing an example of the nozzle arrangement in the print head illustrated in FIG. 2.

The plurality of ink chamber units 53 having such a structure are arranged in a grid with a fixed pattern in the line-printing direction along the main scanning direction and in the diagonal-row direction forming a fixed angle θ that is not a right angle with the main scanning direction, as shown in FIG. 3. With the structure in which the plurality of rows of ink chamber units 53 are arranged at a fixed pitch d in the direction at the angle θ with respect to the main scanning direction, the nozzle pitch P as projected in the main scanning direction is d×cos θ.

Hence, the nozzles 51 (51-11, 51-12, 51-13, 51-14, 51-15, 51-16, . . . ) can be regarded to be equivalent to those arranged at a fixed pitch P on a straight line along the main scanning direction. Such configuration results in a single line nozzle arrangement in which the nozzle row projected in the main scanning direction has a high density of up to 2,400 nozzles per inch. For convenience in description, the structure is described below as one in which the nozzles 51 are arranged at regular intervals (pitch P) in a straight line along the lengthwise direction of the head 50, which is parallel with the main scanning direction.

In a full-line head comprising rows of nozzles corresponding to the entire width of the recording paper, the "main scanning" is defined as to print one line or one band in the width direction of the recording paper (the direction perpendicular to the delivering direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other.

In particular, when the nozzles 51 arranged in a two-dimensional (matrix) such as that shown in FIG. 3 are driven, the main scanning according to the above-described (3) is preferred. More specifically, the nozzles 51-11, 51-12, 51-13, 51-14, 51-15 and 51-16 are treated as a block (additionally; the nozzles 51-21, 51-22, . . . , 51-26 are treated as another block; the nozzles 51-31, 51-32, . . . , 51-36 are treated as another block, . . . ); and one line is printed in the width direction of the recording paper 16 by sequentially driving the nozzles 51-11, 51-12, . . . , 51-16 in accordance with the conveyance velocity of the recording paper 16.

On the other hand, the "sub-scanning" is defined as to repeatedly perform printing of one line or one band formed by the main scanning, while moving the full-line head and the recording paper relatively to each other.

Figure 4:
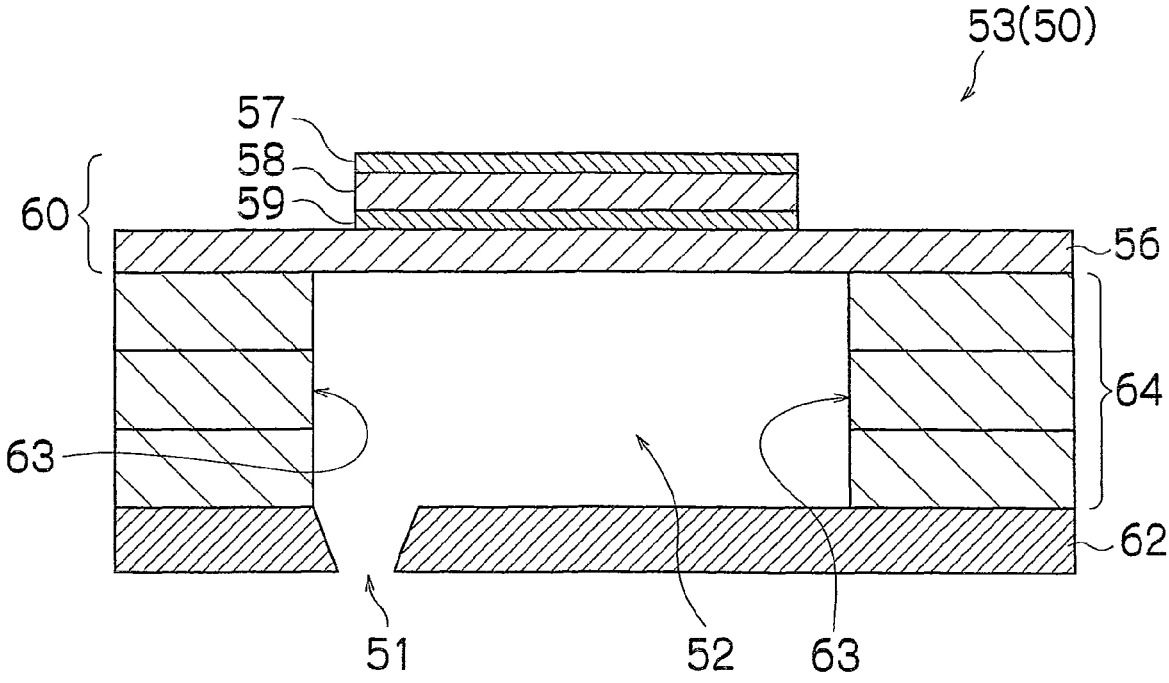
FIG. 4 is a cross-sectional diagram along line 4-4 in FIG. 2B, showing the approximate composition of one embodiment of an inkjet head according to the present invention.

FIG. 4 is a cross-sectional view taken along the line 4-4 in FIG. 2B, showing schematic structure of the ink chamber unit, which is a kind of the inkjet head of the present invention. As shown in FIG. 4, each ink chamber unit 53 of the inkjet head 50 of the present embodiment comprises the nozzle 51 for ejecting ink-droplets, the pressure chamber 52 connecting to the nozzle 51 and being compressed to eject ink, the vibration plate (pressure plate) 56 sealing a surface (ceiling in FIG. 4) of the pressure chamber 52 and forming a part of the pressure chamber 52, and the piezoelectric element (piezoelectric actuator) 58 formed above the vibration plate 56.

As described above, not shown in the drawings, the ink supply port connecting to the pressure chamber 52 and supplying the ink to the pressure chamber 52, is provided. A plurality of the nozzles 51, the pressure chamber 52, etc. as shown in FIG. 4 are arranged in the form of a two-dimensions matrix in horizontal direction of FIG. 4 and vertical direction to a paper of FIG. 4. Each of the ink supply port connects to common channel (not shown in the drawings) and is supplied the ink from the common channel.

Furthermore, a lower electrode 59 and an upper (individual) electrode 57 are respectively formed in a thin layer on the upper surface and the lower surface of the piezoelectric element 58. In order to discharge ink, a voltage is applied between the lower electrode 59 and the upper electrode 57 formed respectively on the lower surface and upper surface of the piezoelectric element 58, thereby causing the piezoelectric element 58 to deform in such a manner that the center of the vibration plate 56 bends toward the pressure chamber 52. The ink inside the pressure chamber 52 is compressed by the change in volume caused by the distortion and deformation of the piezoelectric element 58 and vibration plate 56, and the ink is discharged as an ink droplet from the nozzle 51 connected to the pressure chamber 52. When the voltage applied to the piezoelectric element 58 is returned to its original value, the piezoelectric element 58 and the vibration plate 56 revert to their original states, and ink is replenished into the pressure chamber 52, from the common ink chamber, via an ink support port (not illustrated).

In this way, the vibration plate 56 and the piezoelectric element 58 sandwiched between the lower electrode 59 and the upper electrode 57 constitute a pressure generating unit 60 which applies pressure to the pressure chamber 52.

The nozzle 51 is formed in the nozzle plate 62, and the side walls 63 of the pressure chamber 52 are formed in the flow passage plate 64. The pressure chamber 52 is formed by layering together the nozzle plate 62, the flow passage plate 64, and the vibration plate 56.

A method of manufacturing an inkjet head 50 formed by means of ink chamber units 53 of this kind is described below.

Figure 5A:
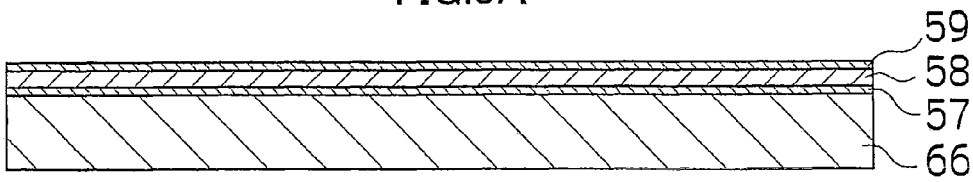
FIGS. 5A to 5E show descriptive diagrams illustrating steps in a method of manufacturing an inkjet head according to the present embodiment.

FIGS. 5A to 5E show the sequence of steps in a method of manufacturing an inkjet head 50 (ink chamber unit 53) in the present embodiment. Firstly, as shown in FIG. 5A, an upper electrode 57, a piezoelectric element 58 and a lower electrode 59 are formed by a thin film forming technique on a silicon or magnesium oxide substrate 66. FIG. 5A is a cross-sectional diagram, and FIG. 6 shows an oblique view of this state. As shown in FIG. 6, a rectangular upper electrode 57, piezoelectric element 58 and lower electrode 59 are formed on the surface of a circular substrate 66 of silicon or magnesium oxide.

Firstly, the upper electrode 57 is formed by sputtering on the substrate 66, and a thin film piezoelectric element 58 is formed thereon by sputtering, or by a sol gel method. A lower electrode 59 is then formed on the piezoelectric element 58, by sputtering. In this way, a three-layered structure consisting of a piezoelectric element 58 sandwiched between an upper electrode 57 and a lower electrode 59 is formed on a silicon or magnesium oxide substrate 66, and it is baked in place by heat treatment.

In this case, the lower electrode 59 is, for example, 1/10 or less of the thickness of the piezoelectric element 58. It is desirable for the lower electrode 59 to be as thin as possible in this way, in order to prevent stress occurring due to crystallization of the electrode during heat treatment.

Figure 5B:
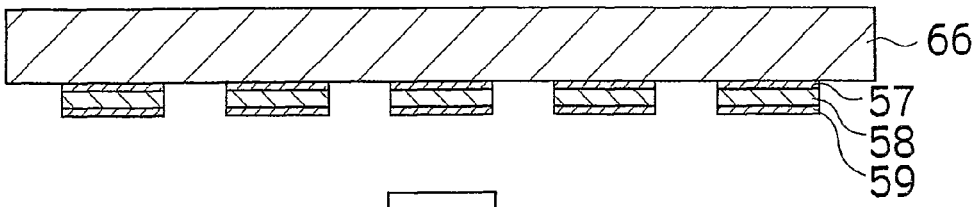
Figure 6:
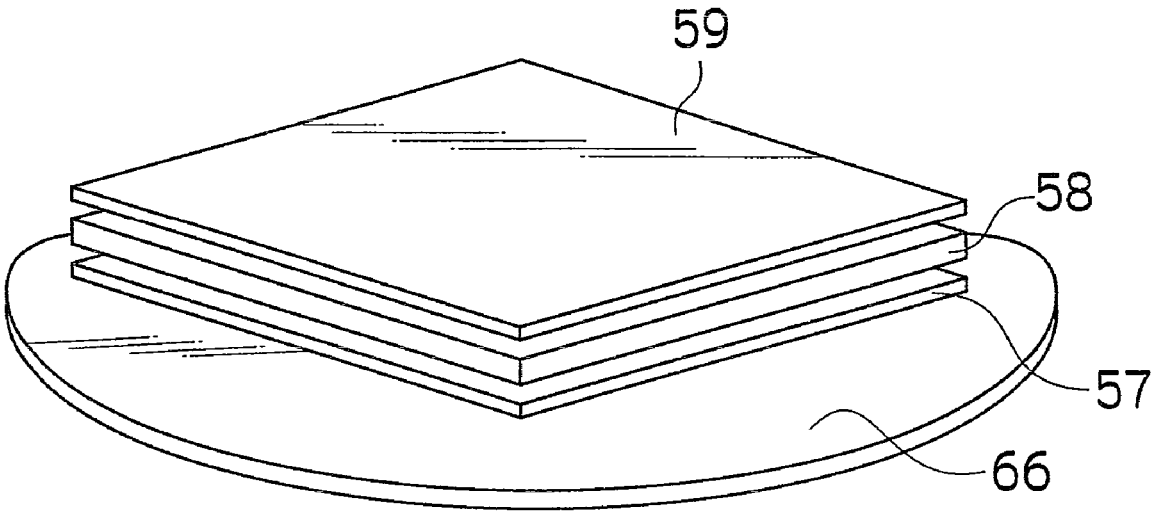
FIG. 6 is a perspective view showing the state of the three-layer structure comprising electrodes and a piezoelectric element formed on the substrate.

Thereupon, as shown in FIG. 5B (where the upper and lower sides are reversed with respect to FIG. 5A), the three-layered structure comprising the upper electrode 57, the piezoelectric element 58 and the lower electrode 59 is divided and formed into individual structures which will correspond with the positions of the pressure chambers 52 when bonded with the vibration plate 56, as described below. There are no particular limitations on the method used for this dividing process; for example, it may be carried out by etching, using a mask, by sand blasting or dicing, ion milling using argon gas, laser machining, or the like.

Figure 5C:
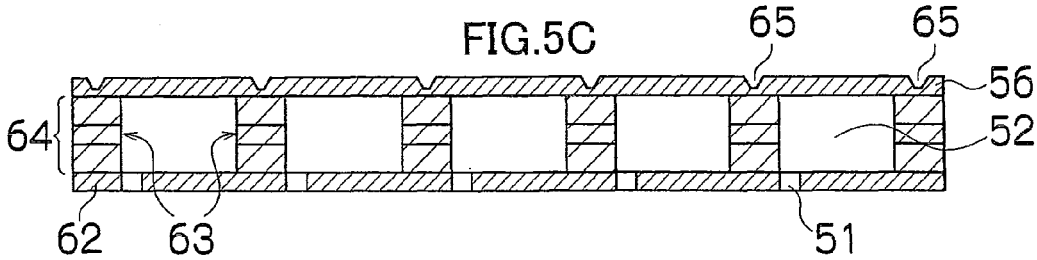

Thereupon, as shown in FIG. 5C, the vibration plate 56, pressure chambers 52 and nozzles 51 are formed, separately. As is widely known in the prior art, these elements are formed by layering together a nozzle plate 62, a flow passage plate 64, and a vibration plate 56, and bonding same by means of an adhesive, or the like.

Firstly, each plate is processed respectively to the required shape. The nozzles 51 are formed by opening holes in the nozzle plate 62. Spaces which are to form the pressure chambers 52 are formed by opening holes in the flow passage plate 64, according to the desired shape of the side walls 63 of the pressure chambers 52. Furthermore, grooves 65 are formed by etching, or the like, on the surface of the vibration plate 56 that is to be bonded subsequently with the piezoelectric element 58.

Desirably, the vibration plate 56 is made from a metal, such as stainless steel, and is fabricated to a prescribed thickness by means of half etching, or the like.

The grooves 65 are provided in order to reduce the rigidity of the vibration plate 56 slightly in the regions where there are provided, thereby increasing the displacement of the vibration plate 56 and piezoelectric element 58, and hence increasing the pressure that can be applied to the interior of the pressure chamber 52. In this way, the vibration plate 56, and the other plates, are manufactured separately by conventional methods, rather than being manufactured jointly with the piezoelectric element 58. This enables greater design freedom with respect to the material and shape of the plates, and allows the stainless steel to be formed to a desired thickness, and the grooves 65 described above to be formed in the plate.

In the example described here, the pressure chambers 52 and the vibration plate 56 are manufactured by layering together respective plates. However, besides this method, it is also possible to use semiconductor technology based on a silicon substrate, for example. In this case, pressure chamber sections are excavated by etching, or the like, on the rear side of the silicon substrate, thereby creating regions of the substrate that will form pressure chambers and vibrations plate situated above the pressure chambers. The pressure chambers (and vibration plates) can then be formed by closing off the cavities on the lower side by bonding a nozzle plate formed with nozzle holes.

Figure 5D:
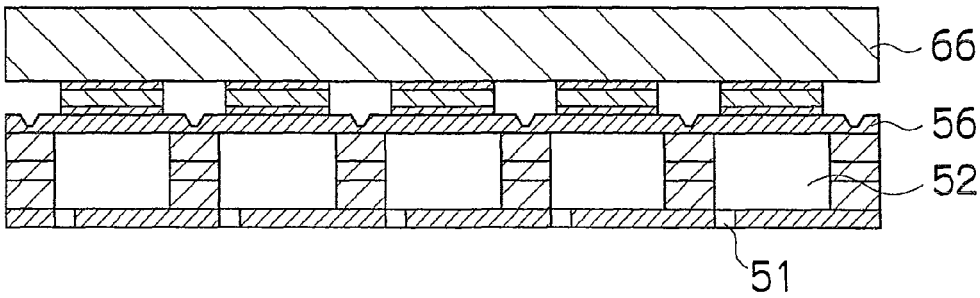

Next, the three-layer structures consisting of an upper electrode 57, a lower electrode 59 and a piezoelectric element 58 formed on the substrate 66 as illustrated in FIG. 5B, are placed on the vibration plate 56 formed with pressure chambers 52 as illustrated FIG. 5C, and they are aligned with the positions of the pressure chambers 52 and then bonded to the vibration plate 56, using an adhesive material, as illustrated in FIG. 5D. Since piezoelectric elements 58 consisting of thin films are formed on the substrate 66 in this way, they can be handled easily when bonding to the vibration plate 56. Furthermore, no warping occurs when they are bonding to the vibration plate 56.

Figure 5E:
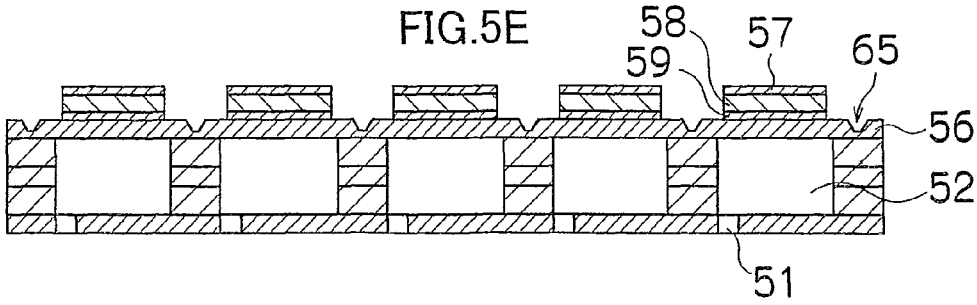

Finally, as shown in FIG. 5E, the substrate 66 is removed from the (three-layered structures of the) piezoelectric elements 58, by etching, thereby completing a inkjet head 50 comprising an array of ink chamber units 53. In these diagrams, a plurality of pressure chambers 52 (ink chamber units 53) are arrayed in the left/right direction, but in fact the pressure chambers 52 are also arrayed in the direction perpendicular to the plane of the diagrams, thus forming an inkjet head 50 having a two-dimensional matrix of pressure chambers 52.

In this way, according to the present embodiment, the vibration plate, the pressure chambers and the nozzles are formed separately from the piezoelectric elements, either by layering conventional plate members, or by using a semiconductor technique for etching silicon, or the like. By then bonding the vibration plate, pressure chambers and nozzles with thin film piezoelectric elements having a thickness of 10 μm or less, which have been formed on a substrate using a thin film forming technique, it is possible to manufacture a high-density inkjet head corresponding to a matrix arrangement, without warping or distortion of the vibration plate.

Furthermore, by forming the piezoelectric elements by means of a thin film forming technique, crystal orientation is superior to that achieved in the bulk material used in a thick film method. Therefore, pore-free elements having high voltage and electric field tolerance can be manufactured. More specifically, the electric field tolerance is generally higher than 10 kV/mm. Furthermore, the piezoelectric element has a larger Young's modulus than a bulk element, and a capacity to generate higher force. Moreover, the polarization is not reversed, even if a negative voltage is applied, and indeed, the element can by driven in the negative direction, thus increasing the possible range of drive waveforms. Therefore, as described above, the size L of the pressure chamber can be shortened in accordance with the reduction made in the thickness of the piezoelectric element, t, while still ensuring the same volume of displacement and generated force. Therefore, the nozzles can be arrayed at higher density.

As described above, according to the present embodiment, the pressure chambers (nozzles) are arranged in a matrix fashion, and the piezoelectric elements are formed by a thin film forming technique. Therefore, the pressure chambers can be reduced in size, and nozzles can be arrayed at higher density.

Furthermore, since the piezoelectric elements and the vibration plate are manufactured separately, and more particularly, the vibration plate, the pressure chambers and the nozzles are manufactured using conventional methods, then stable production can be achieved, and design freedom in respect of the material and shape of the vibration plate is increased. It is also possible to reduce the occurrence of breakdowns in the piezoelectric elements, or other faults caused by warping of the vibration plate or internal stress during formation of the thin films. Moreover, since the piezoelectric elements are formed on a substrate by using a thin film forming technique, they become easier to handle in the processes up to and including bonding with the vibration plate.

The inkjet head, method of manufacturing an inkjet head, and inkjet recording apparatus according to the present invention have been described in detail above, but the present invention is not limited to the aforementioned examples, and it is of course possible for improvements or modifications of various kinds to be implemented, within a range which does not deviate from the essence of the present invention.

What is claimed is:

1. A method of manufacturing an inkjet head, comprising the steps of:

two-dimensionally arranging a pressure chamber, deformed by a pressure generating unit comprising a piezoelectric element and discharging ink from nozzles communicated with the pressure chamber;

forming said piezoelectric element by means of a thin film forming technique;

forming an upper electrode on a substrate by sputtering, said piezoelectric element being formed on said upper electrode by means of the thin film forming technique; and forming a lower electrode on said piezoelectric element by sputtering, wherein said piezoelectric element has a three-layered structure including said upper electrode, said piezoelectric element and said lower electrode, wherein said substrate is removed.

2. The method of manufacturing an inkjet head according to claim 1, further comprising the steps of:

forming a portion of said pressure chamber by a vibration plate; and manufacturing said pressure generating unit by bonding said thin film piezoelectric element to said vibration plate.

3. The method of manufacturing an inkjet head according to claim 2, further comprising a step of:

manufacturing said pressure generating unit by forming said thin film piezoelectric element onto a substrate, bonding said thin film piezoelectric element formed on said substrate with said vibration plate, and then removing said substrate.

4. The method of manufacturing an inkjet head according to claim 2, further comprising a step of:

manufacturing said vibration plate by processing stainless steel, or manufacturing integrally with the pressure chambers by using silicon.

5. The method of manufacturing an inkjet head according to claim 2, further comprising a step of:

forming a groove on said vibration plate in said pressure generating unit, on the side bonded with said thin film piezoelectric element.

6. The method of manufacturing an inkjet head according to claim 1, wherein the thin film forming technique is one of a sputtering method and a sol gel method.

7. The method of manufacturing an inkjet head according to claim 1, wherein a thickness of said lower electrode is not larger than a tenth of a thickness of said piezoelectric element.

* * * * *